US005413516A

United States Patent [19]

Lam

[11] Patent Number: 5,413,516

[45] Date of Patent: May 9, 1995

[54] TALKING TOY DOLL

[75] Inventor: Wing F. Lam, Scarborough, Canada

[73] Assignee: Fung Seng Industrial Co., Ltd., Kowloon, Hong Kong

[21] Appl. No.: 169,061

[22] Filed: Dec. 20, 1993

[51] Int. Cl.[6] ..... A63H 3/28; A63H 3/36

[52] U.S. Cl. ..... 446/301; 446/395

[58] Field of Search ..... 446/300, 301, 302, 303, 446/304, 298, 330, 337, 352, 353, 373, 391, 395

[56] References Cited

U.S. PATENT DOCUMENTS

| | | | |
|---|---|---|---|
| 477,892 | 6/1892 | Fleischmann . | |
| 1,260,159 | 3/1918 | DiMario . | |
| 3,195,268 | 7/1965 | Neumann et al. . | |
| 3,261,124 | 7/1966 | Bodenstein | 446/301 X |
| 3,287,849 | 11/1966 | Weiss . | |
| 3,298,130 | 1/1967 | Ryan . | |
| 3,364,618 | 1/1968 | Ryan et al. . | |
| 3,421,254 | 1/1969 | Ryan et al. . | |
| 3,755,960 | 9/1973 | Tepper et al. . | |
| 3,973,840 | 8/1976 | Jacobs et al. . | |
| 4,139,968 | 2/1979 | Milner | 446/301 |
| 4,232,478 | 11/1980 | Terzian | 446/304 |
| 4,721,437 | 1/1988 | Mitamura et al. | 446/301 X |
| 4,775,352 | 10/1988 | Curran et al. . | |
| 4,805,328 | 2/1989 | Mirahem . | |
| 4,808,142 | 2/1989 | Berliner . | |
| 4,869,703 | 9/1989 | Ong . | |
| 4,923,342 | 5/1990 | Curran . | |
| 5,074,821 | 12/1991 | McKeefery et al. . | |
| 5,108,341 | 4/1992 | DeSmet . | |

FOREIGN PATENT DOCUMENTS

| | | | |
|---|---|---|---|
| 2366855 | 6/1978 | France | 446/304 |

*Primary Examiner*—Robert A. Hafer
*Assistant Examiner*—D. Neal Muir
*Attorney, Agent, or Firm*—Blake, Cassels & Graydon

[57] ABSTRACT

A toy doll with lips that move as speech sounds are produced from a speaker. Pressing a button on the body of the doll activates an integrated circuit that sends voice signals to the speaker, which transmits the sounds. This in turn actuates a switch, causing a motor to run. The drive shaft of the motor rotates, causing a series of meshing gears to turn. The axle of a gear in the series that passes through the eccentric bore of an internal cam causes the cam to move so that it forces an L-shaped cam follower to rock back and forth about a pivot point. The rotatable pivot rod is supported by the rigid torso of the doll, and one end of the cam follower is attached to the interior of the doll's flexible face at a point connecting the two lips. The rocking of the cam follower causes the lips to close and open in a simulation of talking. The motor only runs, and consequently the lips only move, at the same time that simulated speech is transmitted from the speaker. A portion of the doll's rigid body that is interior to its flexible head supports the head and prevents the head and face from collapsing or becoming distorted during operation.

13 Claims, 5 Drawing Sheets

TALKING TOY DOLL

FIELD OF THE INVENTION

This invention relates to toys that generate sounds. In particular, this invention relates to a doll that produces simulated speech while its lips move, these effects occurring in response to physical stimulation by a person.

BACKGROUND OF THE INVENTION

A number of dolls are known that produce sounds, including simulated speech. For some of these dolls, the production of speech is accompanied by movement of the doll's lips.

U.S. Pat. No. 4,808,142 discloses a doll having a flexible head, an integrated circuit that produces synthesized speech, an internal cam and a pivotable cam follower. An end of the cam follower pushes a lower lip to simulate talking, but is not attached to the lips. The doll's head is self-supporting, and all the mechanical and electrical workings of the doll are contained in he head.

U.S. Pat. No. 4,775,352 discloses a doll with two motors that drive, respectively, movable eyes and movable lips. Each lip has a rod for moving the lip into open or closed positions. An external cam with a tracking groove and a cam follower having a pin that rides the groove are used to move the two rods. The operation of the motor coupled to the lips and the playing of a tape that produces sounds have coordinated timing.

U.S. Pat. No. 3,261,124 discloses a doll having lips that move as sounds are produced from a phonograph record. The doll has a flexible, unsupported head. The doll's lips are attached at a single place to a spring mechanism, so that movement of the spring pulls the lips in and pushes them out in a simulation of talking. The end of the spring opposite to the lips is connected to a rod that moves up and down with the rotation of an eccentric disk.

U.S. Pat. No. 3,364,618 discloses a doll with a flexible, unsupported head, movable eyes, movable lips and a phonograph record that produces speech sounds. To simulate talking, the doll's lower lip is pulled with a flexible wire, the wire being attached at its opposite end to a rockable member.

U.S. Pat. No. 4,869.703 discloses a driving mechanism for an animated toy having two pieces that are individually mounted to the toy's lips, an oscillating piece that directs lip movement and a housing that includes a head portion. The mechanism does not provide synthesized speech sounds.

SUMMARY OF THE INVENTION

The present invention provides, in a first aspect, a doll with simulated speech and coincident lip movements. The doll has a hollow rigid body with a head support portion, the head support portion having an aperture; a flexible head having a face with lips, wherein the head is mounted over the head support portion so that the head support portion projects into the head and contacts and supports the face, with the lips being positioned over the aperture; a cam follower having an upper end, a lower end and a fulcrum intermediate between the upper and lower ends, the fulcrum contained in the body, the cam follower being adapted for pivotal movement about the fulcrum backward and forward in relation to the doll's face; a cam that produces oscillation of the cam follower; a motor contained in the body that drives the cam; coupling means coupling the motor to the cam; sound generating means contained in the body for generating pre-defined speech phrases from the doll; circuitry means for activating the motor to move the lips coincidentally with the speech phrases; and switch means for activating the sound generating means. The cam follower has an upper end that is attached to an interior portion of the lips such that on backward movement of the upper end, the lips are pulled inwardly, and on forward movement of the upper end, the lips are pushed outwardly to simulate the appearance of speech.

The doll may include means for activating the motor upon activation of the sound generating means. The sound generating means may include a programmable integrated circuit. It may include a speaker.

The end of the cam follower may be attached to the interior portion of the lips at a single place. The cam follower may be substantially L-shaped. The cam may be internal to the cam follower. The cam may have an eccentric bore and the coupling means have an axle that passes through the bore, the axle being adapted to turn the cam. The coupling means may include gearing.

The switch means may include a pressure-sensitive switch and a switch actuator. The switch actuator may include a push-button on an exterior portion the doll.

In a second aspect, the present invention provides a doll with simulated speech and coincident lip movements. The doll has a hollow rigid body with a head support portion, the head support portion having an aperture; a flexible head having a face with lips, wherein the head is mounted over the head support portion so that the head support portion projects into the head and contacts and supports the face, with the lips being positioned over the aperture; a substantially L-shaped cam follower having an upper end, a lower end and a fulcrum intermediate between the upper and lower ends, the fulcrum contained in the body, the cam follower being adapted for pivotal movement about the fulcrum backward and forward in relation to the face; a cam that produces oscillation of the cam follower, the cam being internal to the cam follower and having an eccentric bore; a motor contained in the body that drives the cam; coupling means coupling the motor to the cam, the coupling means including gearing and an axle that passes through the eccentric bore, the axle being adapted to turn the cam; sound generating means contained in the body for generating pre-defined speech phrases from the doll, the sound-generating means including a programmable integrated circuit; means responsive to the sound generating means for activating the motor to move the lips coincidentally with the speech phrases; and switch means for activating the sound generating means. The cam follower has an upper end that is attached to an interior portion of the lips at a single place such that on backward movement of the upper end, the lips are pulled inwardly, and on forward movement of the upper end, the lips are pushed outwardly to simulate the appearance of speech. The motor is activated upon activation of the sound generating means.

In a third aspect, the present invention provides a doll with simulated speech and coincident lip movements. The doll has a hollow rigid body with a head support portion, the head support portion having an aperture; a flexible head having a face with lips, wherein the head is mounted over the head support portion so that the head support portion projects into the head and contacts and supports the face, with the lips being positioned over the aperture; a cam follower having an upper end, a lower end and a fulcrum intermediate between the upper and lower ends, the fulcrum contained in the body, the cam follower being adapted for pivotal movement about the fulcrum backward and forward in relation to the face; a cam that produces oscillation of the cam follower; a motor contained in the body that drives the cam; coupling means coupling the motor to the cam; sound generating means contained in the body for generating pre-defined speech phrases frown the doll; means for activating the motor to move the lips coincidentally with the speech phrases; and switch means for activating the simulated speech and coincident lip movements. The cam follower has an upper end that is attached to an interior portion of the lips at a single place such that on backward movement of the upper end; the lips are pulled inwardly, and on forward movement of the upper end, the lips are pushed outwardly to simulate the appearance of speech.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE PREFERRED EMBODIMENT

Figure 1:
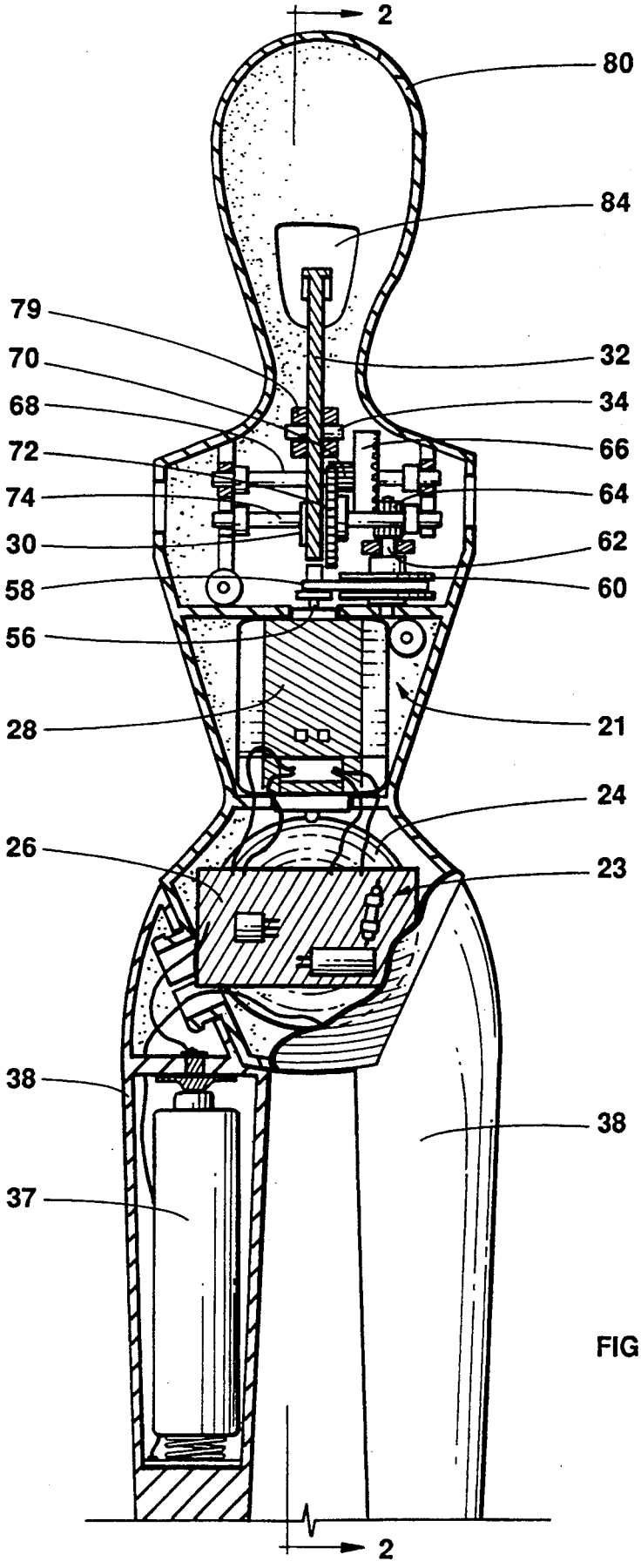
FIG. 1 is a partial cut-away of a rigid body of a talking doll according to the preferred embodiment of the present invention, shown from the back of the doll.
Figure 2:
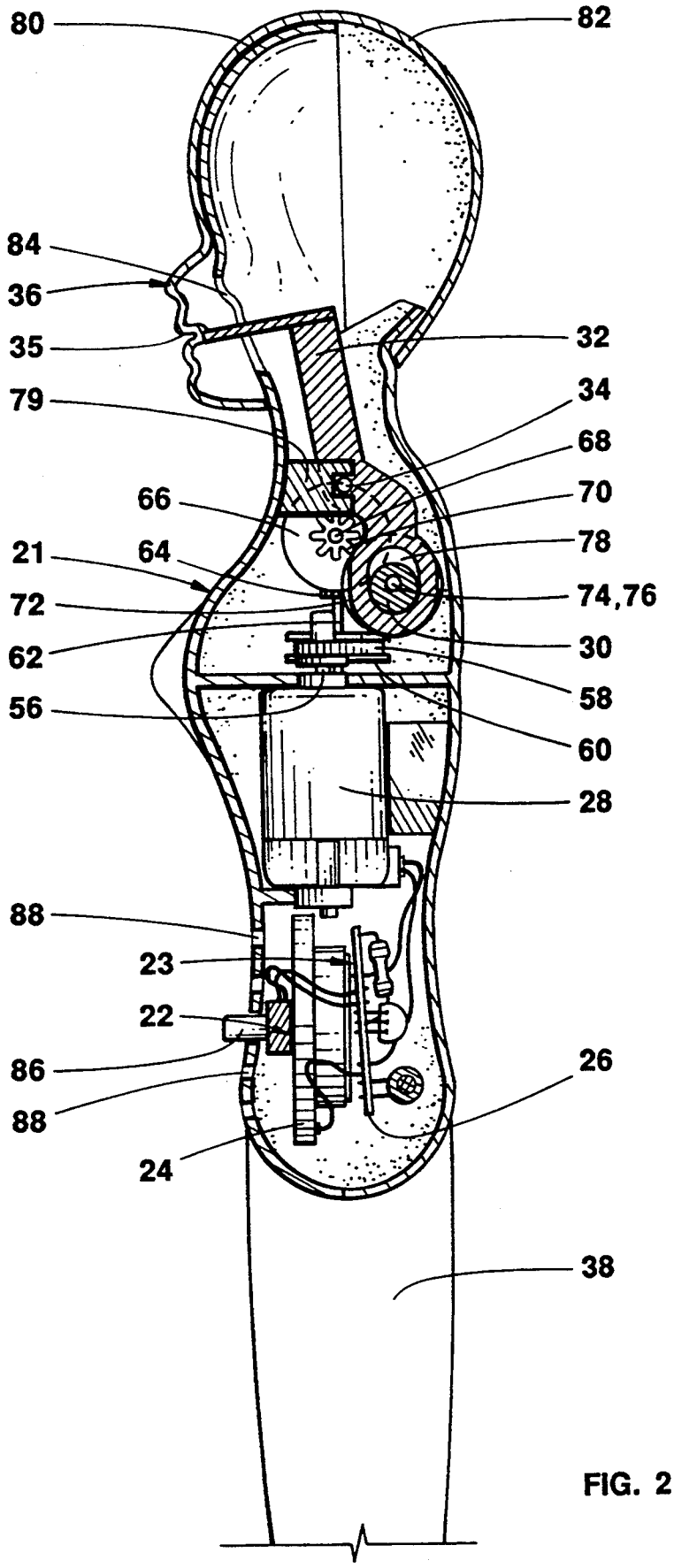
FIG. 2 is a cross-sectional side elevation of the doll of FIG. 1, showing the rigid body fitted with a flexible head.
Figure 3:
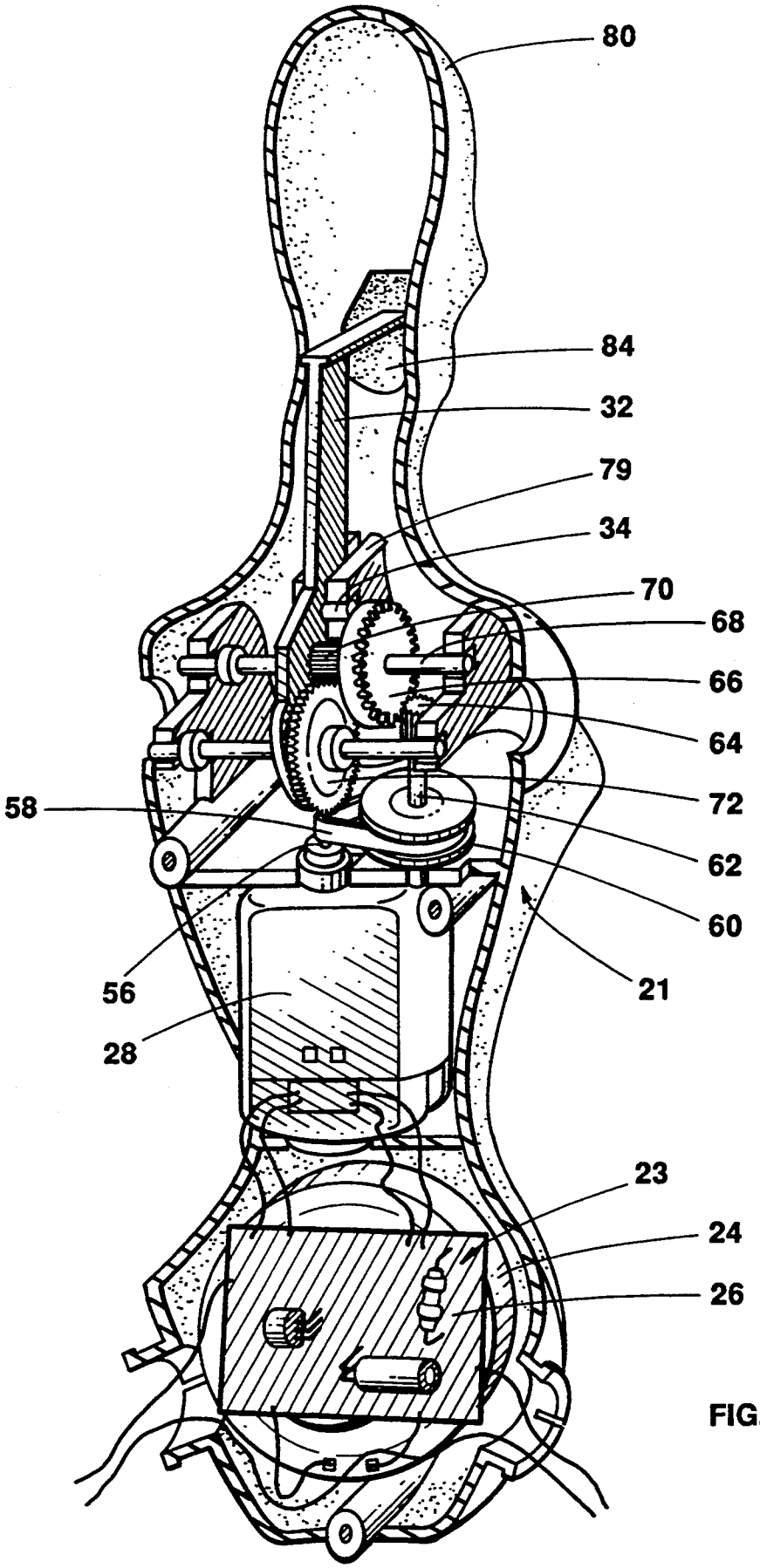
FIG. 3 is a perspective view from the back and right side of a cross-section of a portion of the rigid body of the doll of FIG. 1.

FIGS. 1, 2 and 3 show in partial cut-away or in cross-section a talking doll having a rigid body 21, a pressure-sensitive on/off switch 22; sound generating means 23 that includes a speaker 24 and an integrated circuit or chip 26; a motor 28; an eccentric internal cain 30; a substantially L-shaped cam follower 32 having a pivot 34; and lips 35 in a flexible face 36. The cam 30 and cam follower 32 are depicted in isolation in FIG. 4.

Figure 5:
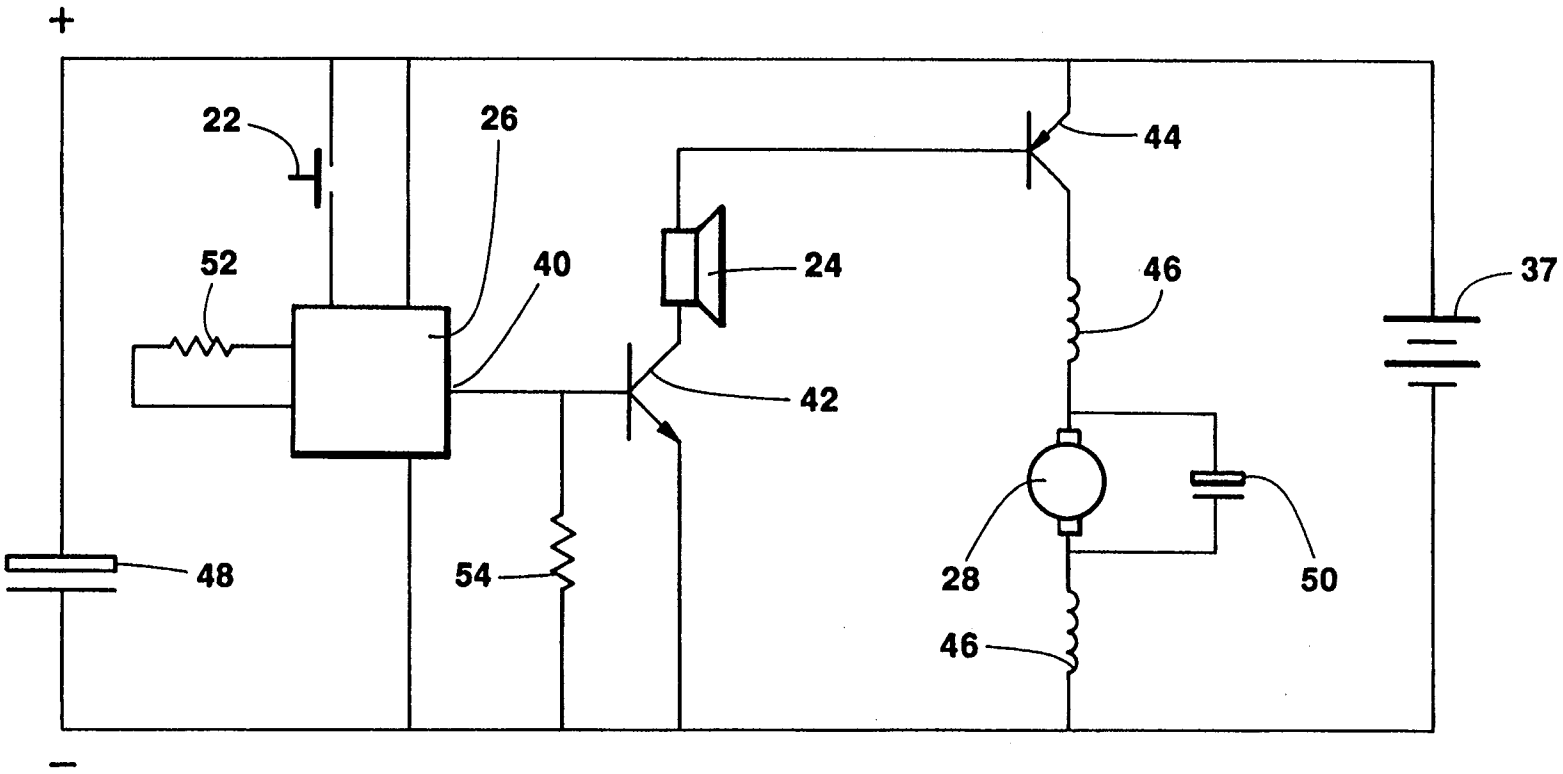
FIG. 5 is a schematic diagram of an electrical circuit of the doll of FIG. 1.

FIG. 5 shows diagrammatically the circuitry of the doll, which includes electrical connections of the pressure-sensitive switch 22, the speaker 24, the integrated circuit 26 and the motor 28. The circuitry is powered by a 3V power source. Preferably, two 1.5V AA batteries 37 are each housed in a leg 38 of the doll, as shown in FIG. 1.

Referring again to FIG. 5, the integrated circuit 26 is a speech synthesis chip that is implemented in C-MOS technology. Preferably, the chip 26 uses the ADPCM coding method to reproduce various kinds of voices. The chip 26 includes a digital/analog (D/A) converter, an ADPCM synthesizer, an ADPCM ROM that can be configured by the manufacturer to produce sound patterns simulating certain words or strings of words, and control and timing logic. Thus, the doll has the appearance of saying certain pre-defined phrases. Preferably, the chip 26 is model WR 5524706 manufactured by Winbond Electronics Group.

The output port 40 of the chip 26 is electrically connected to a first transistor 42 in an amplification mode. Preferably, the first transistor 42 is model 8050D manufactured by Samsung Electronics and sold by Component Supplies Co. The speaker 24 is electrically connected to the collector of the first transistor 42, for receiving and subsequently transmitting amplified analog voice signals.

The speaker 24 is also electrically connected to a second transistor 44, preferably model 5610 manufactured by Samsung Electronics, which is in a switch mode. The second transistor 44 is in turn connected to the motor 28, which is model FA-130RA-12200, an AC motor manufactured by Mabuchi Motor Co., Ltd. The motor is provided with inductors 46 for the conversion of DC power from the batteries 37 to AC power to drive the motor 28. Each inductor 46 is model 6R8K manufactured by Samsung Electronics and sold by Coils Electronic Co., Ltd.

A first capacitor 48 performs a smoothing function to protect the integrated circuit 26 from high frequency noise from the batteries 37. The first capacitor 48 has a capacitance of 33 $\mu$F and performs to a maximum voltage of 16V, above which it would break down. A second capacitor 50 having a capacitance of 33 $\mu$F and also performing to a maximum voltage of 16V is involved in the conversion of DC to AC power for the motor 28. A first resistor 52 has a resistance of 390K ohms. A second resistor 54 has a resistance of 510 ohms and biases the first transistor 42 in amplification mode.

The motor 28 has a drive shaft 56 that drives movement of a belt 58. The belt 58 encircles and drives the movement of a wheel 60 having a first axle 62. An end of the first axle 62 opposite to the wheel 60 has vertical grooves or notches so that the end is a first gear 64. The first gear 64 is arranged to operably engage a second gear 66 that has notches on its face that are sized to mesh with the grooves of the first gear 64. A second axle 68 passes through the second gear 66 and through a third gear 70 that is adjacent to the second gear 66. The third gear 70 meshes with and operably engages a fourth gear 72 on a third axle 74.

Figure 4:
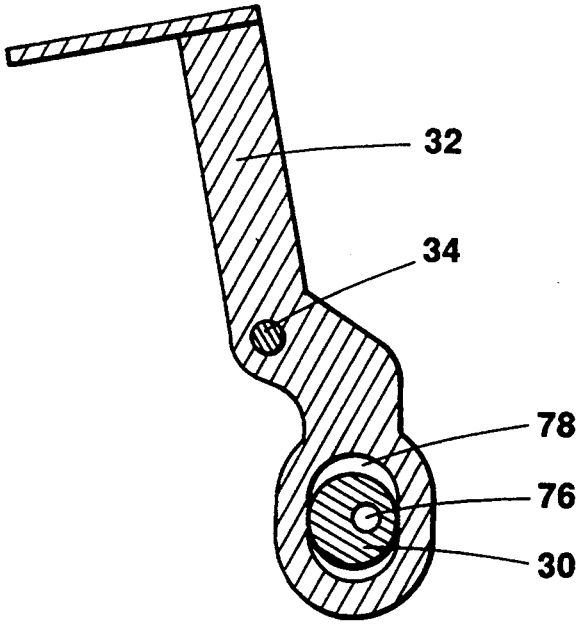
FIG. 4 is an elevational view of an eccentric internal cam and cam follower of the doll of FIG. 1.

The third axle 74 passes through an eccentric born 76 in the cam 30, which bore is depicted in FIG. 4. The cam 30 is disposed inside an oval aperture 78 near a bottom end of the L-shaped cam follower 32. A top end of the cam follower 32 is glued to an interior portion of the lips 35 of the doll. Intermediate between the two ends of the cam follower 32 is the pivot rod 34. Support means 79 for coupling the cain follower 32 to the rigid body 21 is fixedly attached to the torso of the body 21. The support means 79 supports the pivot rod 34 in a such a manner that the pivot rod 34 can rotate, causing the cam follower 32 to rock back and forth and tip and down. The shape of the cam follower 32 is adapted to avoid contact or collision between itself and any of the nearby gears or axles during such rocking movement.

The rigid body 21 has a head support portion 80 over which a flexible head 82 can be fitted. The head support portion 80 has an aperture 84 that, after mounting of the flexible head 82, is positioned beneath the flexible face 36 of the head 82 in the region of the lips 35. A portion of the L-shaped cam :follower 32 passes through the aperture 84, as the top end of the cam follower 32 is glued to the pair of lips 35. The attachment of the cam follower 32 to the lips 35 is at a single place where the two individual lips are joined. The lips 35 are adapted so as to open and close with the movement of the top end of the cam follower 32 during rocking on the pivot 34.

In operation, a person presses a button 86 on the exterior of the doll, as depicted in FIG. 2, which button is a switch actuator of the switch 22. Actuating the switch 22 sends a signal (logic one) to a pin of the integrated circuit 26 that was formerly at logic zero. This activates the integrated circuit 26 to send a voice signal to the first transistor 42, which amplifies the signal. The amplified analog signal is sent to the speaker 24, which transmits the sounds of speech through holes 88 in the belly of the body 21. The transmission of sound, in turn, causes the second transistor 44, acting as a switch, to be actuated. The motor 28 is turned on, with the inductors 46 and capacitor 50 acting to convert DC power to AC power. Thus, under the control of the second transistor 44, the motor 28 runs only with the transmission of sounds frown the speaker 24.

The operation of the motor 28 causes the drive shaft 56 to rotate, which causes the belt 58 to move, turning the wheel 60 and the first axle 62. The rotation of the first axle 62 causes the first gear 64 to mesh with and turn the second gear 66. This causes the second axle 68 to rotate, turning the third gear 70. The third gear 70 meshes with the fourth gear 72, causing it and its axle 74 to rotate. The rotation of the third axle 74 causes the cam 30 to move in the aperture 78. Because of the eccentric position of the bore 56, the cam 30 pushes the cain follower 32 so that the cam follower 32 rocks back and forth, and up and down, about the pivot 34.

Because the lips 35 of the doll are glued to the top end of the cam follower 32, the rocking movement causes the lips 35 to be pulled inwardly and pushed outwardly, so that the mouth appears to close and to open, respectively. Such lip movement only occurs when the motor 28 operates, and therefore is coincident with the transmission of speech sounds from the speaker 24. This provides an impression of the doll talking. The rigid head support portion 80 supports the flexible head 82 such that the head 82 does not collapse or the face 36 become distorted as the cam follower 32 pulls and pushes on the lips 35. This also contributes to the lifelike impression of the doll talking.

The present invention preferably has a single, fixed attachment point for the pair of lips, rather than a cumbersome pair of actuators, one for each lip. Similarly, the use of the compact, internal cam 30 is advantageous, as it is less likely to jam against other components of the doll than an external cam would be. The gear assembly is for reduction of the speed of rotation of the drive shaft 56, and the belt 58 minimizes any noise resulting from the first reduction step. If the cam follower 32 or gears were to become jammed, damage to the components would be reduced by slipping of the belt 58.

This description has been made with reference to the preferred embodiment of the invention. However, it is possible to make other embodiments that employ the principles of the invention and that fall within its spirit and scope as defined by the following claims.

What is claimed is:

1. A doll with simulated speech and coincident lip movements comprising:

i) a hollow rigid body having a head support portion, the head support portion having an aperture;

ii) a flexible head having a face with lips, wherein the head is mounted over the head support portion so that the head support portion projects into the head and contacts and supports the face, with the lips being positioned over the aperture;

iii) a cam follower having an upper end, a lower end and a fulcrum intermediate between the upper and lower ends, the fulcrum contained in the body and the cam follower being adapted to pivot about the fulcrum backward and forward in relation to the face, and the upper end being attached to an interior portion of the lips such that on backward movement of the upper end, the lips are pulled inwardly, and on forward movement of the upper end, the lips are pushed outwardly to stimulate the appearance of speech;

iv) a cam that produces oscillation of the cam follower;

v) a motor contained in the body that drives the cam;

vi) coupling means coupling the motor to the cam;

vii) sound generating means contained in the body for generating pre-defined speech phrases from the doll;

viii) switch means for activating the sound generating means; and ix) circuitry means for activating the motor to move the lips coincidentally with the speech phrases.

2. The doll of claim 1, wherein the sound generating means includes a programmable integrated circuit.

3. The doll of claim 2, in which there is means for activating the motor upon activation of the sound generating means.

4. The doll of claim 3, wherein the upper end of the cam follower is attached to the interior portion of the lips at a single place.

5. The doll of claim 4, wherein the cam follower is substantially L-shaped.

6. The doll of claim 5, wherein the cam is internal to the cam follower.

7. The doll of claim 6, wherein the cam has an eccentric bore and the coupling means has an axle that passes through the bore the axle being adapted to turn the cam.

8. The doll of claim 7, wherein the coupling means includes gearing.

9. The doll of claim 1, wherein the switch means includes a pressure-sensitive switch and a switch actuator.

10. The doll of claim 9, wherein the switch actuator includes a push-button on an exterior portion of the doll.

11. The doll of claim 3, wherein the sound generating means includes a speaker.

12. A doll with simulated speech and coincident lip movements comprising:

i) a hollow rigid body having a head support portion, the head support portion having an aperture;

ii) a flexible head having a face with lips, wherein the head is mounted over the head support portion so that the head support portion projects into the head and contacts and supports the face, with the lips being positioned over the aperture;

iii) a substantially L-shaped cam follower having an upper end, a lower end and a fulcrum intermediate between the upper and lower ends, the fulcrum contained in the body and the cam follower being adapted to pivot about the fulcrum backward and forward in relation to the face, and the upper end being attached to an interior portion of the lips at a single place such that on backward movement of the upper end, the lips are pulled inwardly, and on forward movement of the upper end, the lips are pushed outwardly to simulate the appearance of speech;

iv) a cam that produces oscillation of the cam follower, the cam being internal to the cam follower and having an eccentric bore;

v) a motor contained in the body that drives the cam;

vi) coupling means coupling the motor to the cam, the coupling means including gearing and an axle that passes through the eccentric bore, the axle being adapted to turn the cam;

vii) sound generating means contained in the body for generating pre-defined speech phrases from the doll, the sound generating means including a programmable integrated circuit;

viii) switch means for activating the sound generating means; and ix) means responsive to the sound generating means for activating the motor to move the lips coincidentally with the speech phrases wherein the motor is activated upon activation of the sound generating means.

13. A doll with simulated speech and coincident lip movements comprising:

i) a hollow rigid body having a head support portion, the head support portion having an aperture;

ii) a flexible head having a face with lips, wherein the head is mounted over the head support portion so that the head support portion projects into the head and contacts and supports the face, with the lips being positioned over the aperture;

iii) a cam follower having an upper end, a lower end and a fulcrum intermediate between the upper and lower ends, the fulcrum contained in the body and the cam follower being adapted to pivot about the fulcrum backward and forward in relation to the face, and the upper end being attached to an interior portion of the lips at a single place such that on backward movement of the upper end, the lips are pulled inwardly, and on forward movement of the upper end, the lips are pushed outwardly to simulate the appearance of speech;

iv) a cam that produces oscillation of the cam follower;

v) a motor contained in the body that drives the cam;

vi) coupling means coupling the motor to the cam;

vii) sound generating means contained in the body for generating pre-defined speech phrases from the doll;

viii) switch means for activating the simulated speech and coincident lip movements; and ix) means for activating the motor to move the lips coincidentally with the speech phrases.

* * * * *